US008057218B2

(12) United States Patent
Glück et al.

(10) Patent No.: US 8,057,218 B2
(45) Date of Patent: Nov. 15, 2011

(54) METHOD FOR BURNING LIQUID FUELS

(76) Inventors: Christoph Glück, Markt Allhau (AT); Walter Zischka, Markt Allhau (AT)

( * ) Notice: Subject to any disclaimer, the term of this patent is extended or adjusted under 35 U.S.C. 154(b) by 155 days.

(21) Appl. No.: 12/522,202

(22) PCT Filed: Dec. 21, 2007

(86) PCT No.: PCT/AT2007/000588

§ 371 (c)(1),
(2), (4) Date: Nov. 25, 2009

(87) PCT Pub. No.: WO2008/080183

PCT Pub. Date: Jul. 10, 2008

(65) Prior Publication Data

US 2011/0045419 A1 Feb. 24, 2011

(30) Foreign Application Priority Data

Jan. 4, 2007 (AT) ..... A 21/2007

(51) Int. Cl.
*F23D 11/10* (2006.01)

(52) U.S. Cl. ..... 431/12; 431/8; 431/10; 110/348

(58) Field of Classification Search ..... 431/12, 431/8, 10, 351; 110/348
See application file for complete search history.

(56) References Cited

U.S. PATENT DOCUMENTS 5,170,727 A * 12/1992 Nielsen ..... 110/346

* cited by examiner

*Primary Examiner* — Alfred Basichas
(74) *Attorney, Agent, or Firm* — Laurence A. Greenberg; Werner H. Stemer; Ralph E. Locher

(57) ABSTRACT

A method for burning liquid fuels, wherein an amount of total combustion air required for burning is introduced into the liquid fuel in the form of small air bubbles to provide a highly variable overall heat output, particularly at least within a range of one to fifty times the amount of heat output in a similar system, where the liquid fuel/air mixture produced is at least 10 bar. The combustion air is intermittently fed to an injection nozzle protruding into a combustion chamber and is atomized there to produce an explosion at a constant injection pressure. The duration of each of the liquid fuel/air mixtures introduced with each fuel injection pulse is kept constant at a desired value and the total amount of the liquid fuel/air mixture injected per time unit is adjusted between constant fuel injection pulses by varying the duration. The remaining amount of the combustion air is introduced in the combustion chamber through an air nozzle annularly surrounding the port of the injection nozzle.

16 Claims, 2 Drawing Sheets

METHOD FOR BURNING LIQUID FUELS

BACKGROUND OF THE INVENTION

Field of the Invention

The present invention concerns a new method for burning of liquid fuels in heating systems, boiler plants or the like with at least one injection nozzle protruding into a combustion chamber essentially under ambient pressure and being in direct contact with the external atmosphere via the exhaust gas duct, able to be loaded intermittently with a liquid fuel at constantly uniform pressure, with the feed for combustion air being arranged in direct proximity to its nozzle port.

Intermittent feeding of fuel through injection nozzles into combustion chambers of internal combustion engines, on the one hand, and heating systems, boiler plants, and the like, on the other, are already long since familiar.

As for the prior art in this respect, several of the known documents shall be mentioned hereafter and briefly discussed.

DE 1277499 sets forth devices for the injecting of liquid fuel into ceramic ovens with high pressure and large pulse count, especially using specially designed electric valves as the injection devices.

From DE 4113067 is known a feeding device for liquid fuel to a heating burner, especially an oil burner, having a pulse control system by which it is possible to control the power even in the case of low installed power. It provides for a switching valve controlled by appropriate pulses.

In DE 10040868 a method is described for reduction of thermoacoustic vibrations, wherein a mixture of fuel and air is introduced into a burner via a fuel nozzle and this fuel is pulsed with a frequency between 1 Hz and 1000.

From WO 2004/055437 an injection nozzle for a burner for liquid fuel is described, which is also designed for low burn rates. A valve is provided here that forms the inflow of fuel into a pulsation.

From U.S. Pat. No. 5,158,261 a controller for the injection of a liquid fuel into the burner of a boiler or the like is known, wherein the fuel can be introduced in pulsating and measured manner via a spindle.

From U.S. Pat. No. 3,798,901 a device is known wherein a fuel valve opens and closes periodically at predetermined intervals of time.

Although some of these known burning methods also have a heating power variability within certain bounds, until now there has been no method in which a variation of the heating power of a furnace system is assured for the most diverse purposes of generation of heat within broad limits with good effectiveness over the entire power range at the same time.

The invention has set itself the problem of creating such a flexible and at the same time thermodynamically effective burning method in which a new technique, not yet customary in this branch, of intermittent supply of liquid fuel is adopted.

BRIEF SUMMARY OF THE INVENTION

Thus, the subject of the invention is a new method for burning of liquid fuels according to the preamble of claim 1, having the features set forth in the characterizing passage of this claim.

In order to attain the highest possible effectiveness of utilization of the caloric content of the liquid fuel, an admission of a second portion of the combustion air coordinated with the intermittent injection of the fuel/air mixture is advantageous according to claim 2.

In the course of extensive investigations in the process of development of the method of the invention, it has proven to be especially favorable to reducing the environmentally harmful components in the exhaust gas or smoke gas to admit likewise intermittent urea as a solution into the combustion chamber, roughly in the vicinity of its exhaust gas exit, being coordinated with the injection pulses of a liquid fuel/air mixture and the second portion of combustion air, as set forth in claim 3.

According to claim 4, one favorable way of regulating the admission of air bubbles of the first air portion into the liquid fuel by using appropriate sensors is described.

Especially to reduce the danger of blocking or plugging of mechanisms of the furnace system, such as the high-pressure pump, with solid grease fractions, and/or to lower the viscosity of the liquid fuel, especially biofuel, for a better admission by nozzle, a preheating is advantageous, as described in claim 5.

Claims 6 to 9 indicate especially favorable fuel injection pulse times, interval times between the fuel injection pulses, air admission pulse times and urea admission pulse times in regard to high thermal yields in the heating system.

Claim 10 discloses an especially economic method of preheating the second portion of combustion air being supplied directly to the combustion nozzle.

Claim 11 deals with an advisable use of a lambda probe in the context of the invented method.

Claim 12 gives further information on an advantageous way to specifically implement the intermittent feeding of the fuel.

Claim 13 deals with the returning of excess fuel/air mixture from the high-pressure pump or from the injection nozzle and separating the air contained therein.

Claim 14 deals with a favorable way of regulating the amount of air introduced.

The question of the ignition of the fuel/air mixture supplied to the injection nozzle is the subject of claim 15.

Finally, yet another air supply to the fuel cloud in the combustion chamber is described in claim 16.

The new method of burning liquid fuel is especially useful for both vegetable oils, pyrolysis oils, glycerin and for light and extra light heating oil. The burner is able to modulate its power continuously between 10 and 100%. To achieve this effect with highly viscous fuels, it has proven to be advantageous to use a pressure of over 100 bar or even up to at least 200 bar to achieve the most optimal atomization of vegetable oil, for example. Due to this high pressure, a continual injection into the combustion chamber is not possible, for even with the smallest possible nozzle more fuel would be injected than needed for the lowest heating power of the burner, e.g., 3 kW or 0.31 of heating oil with a caloric content of 10 kW/l.

Therefore, the pulsating injection of fuel into the combustion space according to the invention is absolutely necessary to achieve the above described unprecedented and unachievable modulation capacity of the heating power.

Important features and benefits of the new furnace system are the following:

1. Use of injection nozzles or a combination of electromechanical valve and nozzle in combustion chambers where the ambient pressure is prevailing and which are not designed to drive an internal combustion engine with air compression.

2. The injecting into the combustion chamber occurs over a particular power range, always with a constant injected amount of liquid fuel per injection. The power modulation is done by changing the frequency of injection. The amount injected each time can be changed in steps or continuously to broaden the power range.

3. Air is mixed in directly into the liquid fuel before it is compressed, for which a first portion of the total mixture of combustion air needed for the burning of the fuel is used.

4. A specific and pulsating blowing of air is done, being the second portion of the total air needed for the combustion, into the fuel cloud in the combustion chamber.

5. Advantageously, there is a preheating of the pulsating spray of the second air portion by a heating register in the combustion chamber.

6. There is a further injection of urea into the combustion chamber, being only under ambient pressure and also not part of an internal combustion engine within which the air is compressed prior to the injection of the liquid fuel.

BRIEF DESCRIPTION OF THE SEVERAL VIEWS OF THE DRAWING

The invention will be explained more closely by means of the drawing.

DESCRIPTION OF THE INVENTION

Figure 1:
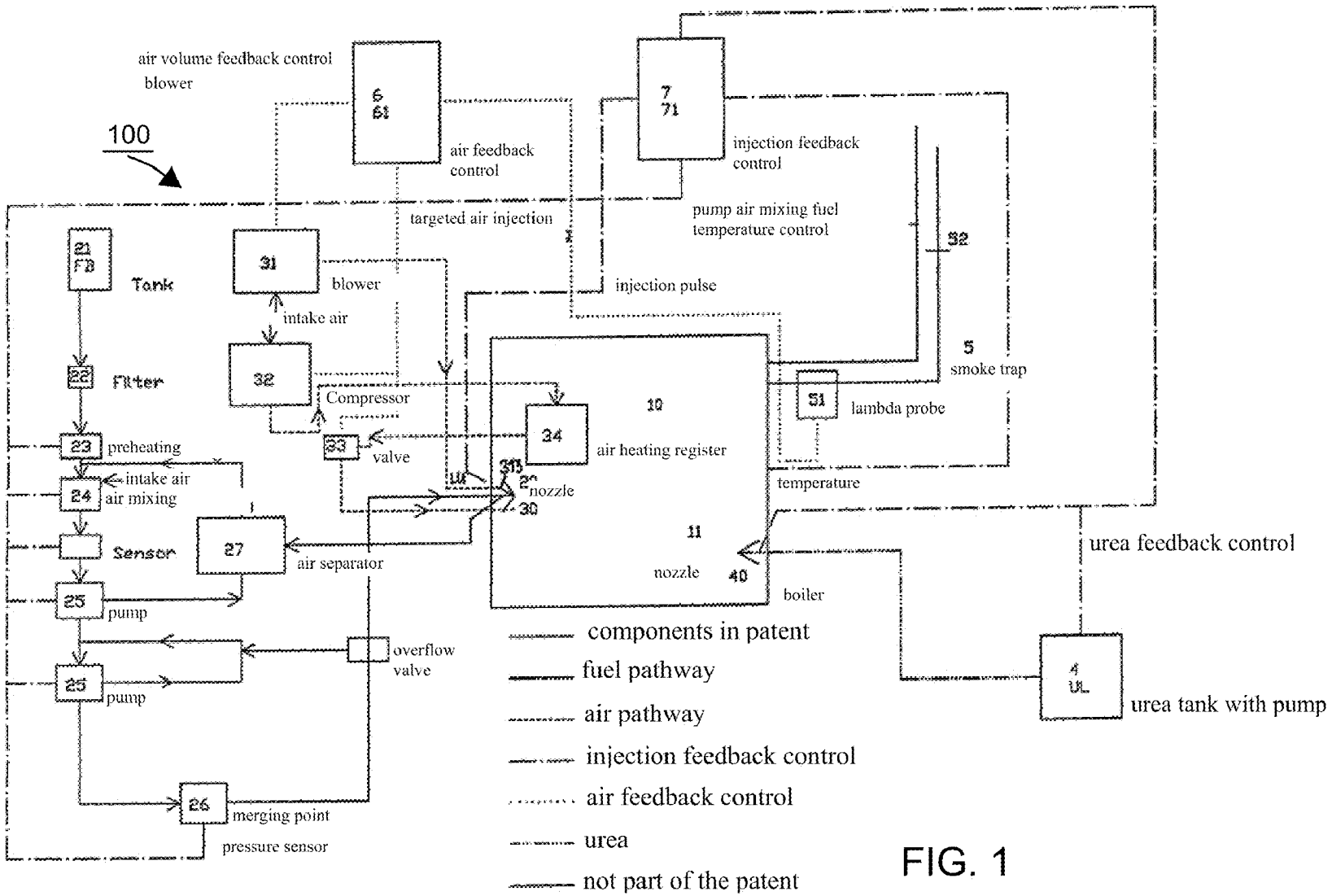
FIG. 1 shows a plan of the new method and FIG. 2 a diagram showing a typical sequence of the intermittent admissions of fuel/air mixture (BLG), second combustion air portion (VL2) and urea (UL) into the combustion chamber.

The new burning method is described in detail by means of the operation of a furnace layout 100 designed for this purpose, as shown in FIG. 1.

In order to protect the high-pressure pump 25 and also the atomizing nozzle 20 in the combustion chamber 10, oil (FB) preferably preheated by a tank line heating system is taken from the tank 21 through one or more fine filters 22 and filtered there. The preheating in a preheating unit 23 prevents a clogging of the filter or filters 22 with solid grease or paraffin particles.

If the oil or the like which is provided as the liquid fuel FB has a relatively high viscosity, such as rapeseed oil with 38 mm2/s at 40° C. per DIN EN ISO 3104, it is necessary to preheat the fuel FB to a temperature of 80° C., for example, by means of a heating system 23, such as an electrical one. This preheating 23 helps with better injection and also heightens the operating security of the high-pressure pump 25.

The process is regulated in this regard during operation by means of a temperature sensor, not otherwise shown, in the already discussed preheating unit 23.

The overflow of the high-pressure pump 25 is taken directly back to the line downstream from the preheater 23 via an air separator 27 in order to lower the consumption of electric power on the preheating and at the same time ensure that the thermally treated liquid fuel, such as vegetable oil, no longer gets back to the tank 21, or else the storage capability of the oil stored there would be reduced. During standstill of the heating system 100 of the invention, the preheater 23 is shut off, being turned on prior to starting up the heating system, in order to heat the fuel there.

When operating with Extra Light heating oil, use of this preheating unit 23 is not necessary and therefore it is also not active in this case.

In order to achieve a substantially better and more effective burning of the liquid fuel FB in the combustion chamber 10, the partial vacuum present in the suction line of the high-pressure pump 25 is used to introduce purified and filtered air, namely, a relatively lesser first volume portion VL1 of the overall combustion air needed VL, as very tiny bubbles into the mass flow of the fuel FB through a thin injection lance, especially one with a borehole of less than 1 mm, in an air proportioning unit 24 and/or by means of another kind of dosing device, and it is thus mixed in with the liquid fuel FB, forming there a liquid fuel and air mixture BLG.

If there is no partial vacuum in the mentioned suction line, a compressor, for example, will be used to introduce the air bubbles. After the air has been mixed in, a sensor, especially a capacitive sensor, will measure the air concentration in the fuel/air mixture BLG and report this to the regulating unit 71 for the injection.

In one possible embodiment, two independent signals will be sent by the sensor, namely, "On" and "Off" via a hysteresis and an analog signal of the air concentration, e.g., proportional to 0 to 10 Volts. Only the air mixing via a valve is turned on and off by "On" and "Off", to prevent too high an air concentration in the fuel/air mixture BLG.

The analog signal of the injection regulating unit 71 adjusts the air concentration in the fuel/air mixture BLG precisely to the current fuel volume flow by a regulated air pump (not shown) and adds it in appropriate dosage in the air proportioning unit 24.

If there are several pumps connected in series, combustion air is added in each pressure stage of the fuel FB or fuel/air mixture BLG. Several pumps can also be grouped together as a multistage high-pressure pump 25.

Excess fuel/air mixture BLG is removed via an overflow valve at the place of the high-pressure pump 25 with the highest pressure and can be admitted back in, for example, upstream from the last pressure pump or upstream from the pressure pump with the lowest pressure.

By boosting the pressure in the high-pressure pump 25, the volume of the air bubbles is reduced by more than 100 times, in the case of rapeseed oil, and they then have a diameter of under 0.5 mm, for example. Upon emerging from the atomizing nozzle 20 of the burner in the combustion chamber 10, the air bubbles then expand explosively, which further assists the atomization of the fuel. Likewise, additional air is already contained in the exiting jet of the atomizing nozzle 20, namely, supplied via the nozzle 30, being the second combustion air portion VL2, which improves the burning and supports the atomization.

The pressure in the line to the atomizing nozzle 20 is increased by means of the high-pressure pump 25 to over 100 bar, for example. For this, pump elements of various technologies can be integrated in a single housing.

If a mechanical injection nozzle 20 is used in the burner, where the nozzle needle lifts off only at a minimum pressure and closes when the pressure drops below opening pressure, the pulsating pressure for the injection will be generated in an injection pump. The injection volume is regulated in terms of the volume of liquid fuel compressed in the injection pump, resulting in different opening times and periods for the atomizing nozzle 20.

If the burner has an electromechanical magnetic-valve injection nozzle 20 or a piezo-valve injection nozzle 20, the necessary operating pressure will only be generated during the burner operation by said pump, and will not be directly related to the injection cycle. It makes no difference whether the magnetic and piezo valves are used separately or combined as a unit with the nozzle.

Various techniques can be used to make sure of the pressure applied and the required volume flow: either a pressure regulation, such as an overflow valve, a regulation in terms of the supplied volume, or a regulation which is a combination of these two variants. The injected quantity of liquid fuel/air mixture BLG and thus the quantity of fuel FB is regulated either by the opening duration of the magnetic valve or by the opening duration and opening width of the piezo-valve.

The opening frequency in both cases remains constant and only the opening duration and opening width is changed to regulate the fuel volume.

The excess liquid fuel/air mixture BLG of the high-pressure pump 25 on the one hand and/or the injection nozzle 20 on the other hand is taken back to the fuel circuit after the preheating 23 by an overflow and leakage line through the air separator 27.

In burners of higher power, the pump power will be regulated by frequency transformer, in order to lower the consumption of electric energy. The volume flow in the mentioned overflow line will be reduced at low power. The power and speed of the high-pressure pump 25 will be regulated by a pressure sensor in its high-pressure region.

By an air enrichment of the liquid fuel FB, the air contained in the excess fuel FB of the high-pressure pump 26 and the injection nozzle 20 is removed before being returned to the high pressure pump 25. This is done by a settling tank with air separator 27 in the fuel overflow circuit. Thanks to the lower velocity, especially due to higher temperature, the larger air bubbles are quickly separated from the fuel. At constantly prevailing temperature and pressure, the volume flow in the excess line in the settling tank 27 is the deciding factor.

If the injection pump 25 has several high-pressure connections to the injection nozzles, as in internal combustion engines, these can be taken to a single mechanical nozzle by one or more collectors or merging points 26. Depending on the number of high-pressure connections and collectors, the rpm can be reduced to maintain the desired injection interval. The sequence of the high-pressure connections is only relevant when using more than one injection nozzle.

If an electromechanical injection nozzle is used, this part is unnecessary and will to be replaced by a part with an enlarged cross section.

Thanks to the injection nozzle 20, the fuel/air mixture BLG is finely atomized, depending on the high-pressure pump 25, and mixed with the portion VL2 of combustion air VL, supplied via, e.g., an annular nozzle 30, without compression and distributed in the combustion chamber 10 standing at ambient pressure, of the new furnace system not used as an internal combustion engine.

The principal area of application of the invention is a use in heating boiler installations for the heating of water for systems requiring thermal energy to prepare heating, process, and warm water.

Despite the pulsating or intermittent injection, when the combustion chamber 10 is viewed as a whole there is a continual, i.e., uninterrupted burning of the fuel/air mixture BLG in the combustion chamber 10, so that only an initial ignition of this is required.

When mechanical or electromechanical injection nozzles are used, the injection duration and thus the injection volume is constant, unlike internal combustion engines, and the power is regulated in terms of the injection cycles per unit of time.

Thus, when using an additional injection of a urea solution UL into the combustion chamber 10 for the reduction of NOx in the combustion exhaust gases VA escaping through the exhaust conduit 51, the injection volume of the urea UL introduced likewise intermittently from the urea tank 4 via the nozzle 40 in the section 11 of the combustion chamber 10 near the start of the exhaust conduit 52 is also constant.

The figures indicated in the course of the compression when mixing air into the liquid fuel are given kWh/kg or only in kg.

Thanks to the high and at the same time continuous modulation capacity of the described new furnace system 100 achieved by the invention, the fuel volumes are bounded at the top and bottom, depending on the usage and type or model of the boiler.

As an example, take a burner for the maximum heating power of a combustion chamber 10 or boiler of 25 kW: starting from the lowest heating power of 0.3 kg/h (=3 kWh) rapeseed oil, injection occurs continuously and adapted to the required heating load and delivery power of the pumps to the heating circuits by forward and return regulation up to 2.5 kg/h (=25 kW) rapeseed oil. Thus, the minimum heating power corresponds to an injection of 0.0833 g/s and maximum heating power of the example is 0.6944 g/s.

No changes occur in the other furnace specifications, whether one uses mechanically or electromechanically controlled valves with nozzles or mechanical or electromechanical injection nozzles 20, 30, 40.

For the reduction of NOx, as already mentioned, urea UL is sprayed or injected into the combustion chamber 10 after the main burning of the liquid fuel FB into the already cooler smoke gas VA at the end of the combustion. A clear and direct time relationship is maintained between the injection of the fuel/air mixture BLG and that of the urea UL.

In contrast with other internal combustion engines, in the invented method the smoke gas or combustion exhaust VA exists in a noncompressed state and therefore is not used for any expansion work in any cycle, apart from the buildup of pressure by the resistance to flow along the path of the smoke gas 51.

To ignite the liquid fuel or oil and air mixture BLG, a high-voltage arc igniter is used advantageously.

Thanks to an air limiting gate, the volume of incoming fresh air taken through the combustion chamber 10 and preheated or not preheated in the heating register 34 there is limited according to the heating power, in order to maintain the optimal mix ratio of air VL and liquid fuel FB for the combustion.

The continuous modulation capacity of the volume of liquid fuel FB requires that the volume of air in the second portion VL2 of combustion air VL introduced into the combustion chamber 10 through the air admission nozzle 30 of the burner also be adapted. In this way, the overall air volume is modulated.

The setpoint for the servo-drive of the air limiting gate is determined by the lambda probe 52 at the start of the exhaust conduit 51. Hence, the volume of air from the high-pressure connections makes up or amounts to the overall air volume needed for the combustion minus that volume of air already present in the fuel/air mixture.

Regulating of the combustion air volume as a whole occurs by means of the air volume regulating unit 6, 61 for the blower for the supply of additional air via an air intake opening 313 in proximity to the nozzle 20 and 30 into the combustion chamber 10 and for the compressor 32 responsible for the intermittent supply of the second portion VL2 of combustion air VL.

In burners with higher power, advantageously there is additionally a regulation of the rpm via frequency transformer, in order to lower the consumption of electric energy by the blower 31 and/or compressor 32.

In order to lower the exhaust losses in the lower power range, not only is the fuel/air mixture BLG injected pulsating or intermittently, but also the additional pulsating and targeted blowing of the second portion VL2 of combustion air VL occurs essentially in the interval of these injections, as mentioned, using at least one air admission nozzle 30 of the burner, into the vaporized fuel in the combustion chamber 10.

This air is taken in the compressed state across a heating register 34 located in the combustion chamber 10 and warmed up there to accomplish an easier ignition and thus optimize the burning, and the air is supplied via a valve 33 to the air admission nozzle 30.

To regulate the makeup of the mixture and thus the exhaust composition, the burner requires a telemetry device which can measure the exhaust gases VA or detect whether the mixture is too rich or too lean. This function is now taken on by the lambda probe 52, from the slightest partial load to the full load. It constantly measures, through a comparative oxygen measurement, the portion of oxygen in the exhaust AV remaining after the combustion.

The lambda probe 52, which is positioned in the smoke gas flue 51, furnishes the control deviation from the optimal burner data which is equalized by the feedback loop via the servo motor at the air limiting gate. Since the exhaust values lie below the operating temperature of 300° C. of the lambda probe 52, it is beneficial for this to be outfitted with a heating system. The heating occurs at once with the demand signal, so that feedback control can be implemented by the automatic burning units 7, 6, 71, 61 immediately after the ignition process is finished. The air throttling achieved in this way after the air flushing goes to the good of the ignition and if the oxygen supply is too lean it is corrected right away.

Thanks to the pulsating operation of the burner, the lambda probe 52 is operated in the lower optimal measurement range when the heating power is low, in order to reduce the exhaust losses. To maintain a stable feedback control, the correction of the negative deviation is delayed in proportion to the time difference between two injections.

All elements of the ignition mechanism, sequence controls, and safety mechanisms are of standard design, per engineering codes.

The feedback control to be used with the invented method, having the function of controlling the injection intervals, must fulfill the following two tasks in particular: regulating the temperature of the energy carrying medium and adapting the power to the heat consumption at the given time.

According to the goal of a system operating by the new method of the invention, the temperature of the energy carrier medium is constant, or variable in terms of given parameters. By detecting the output temperature, the mean sum temperature of the combustion pulses and times or intervals between the combustion pulses in the combustion chamber is regulated in dependence on the requirements by changing the fuel volume.

Only the required heating power is a critical criterion. The flow temperature is varied to control the heating power at the heating elements of a heating plant. At constant flow velocity of the heating medium, the required heating power corresponds to the difference between forward and return flow at the heating boiler. The task of the feedback control is to keep this difference constant, once it is set.

For this purpose, the injected fuel volume alone is changed by the invention's varying of the injection frequency. Thanks to the concomitant holding of the fuel injection volume constant per injection cycle, the quantity of admitted urea UL per injection cycle is also nearly constant and does not have to be explicitly controlled, but instead is regulated as the sole control variable by the particular setpoint fuel/air mixture injection duration and, thus, injection volume.

Figure 2:
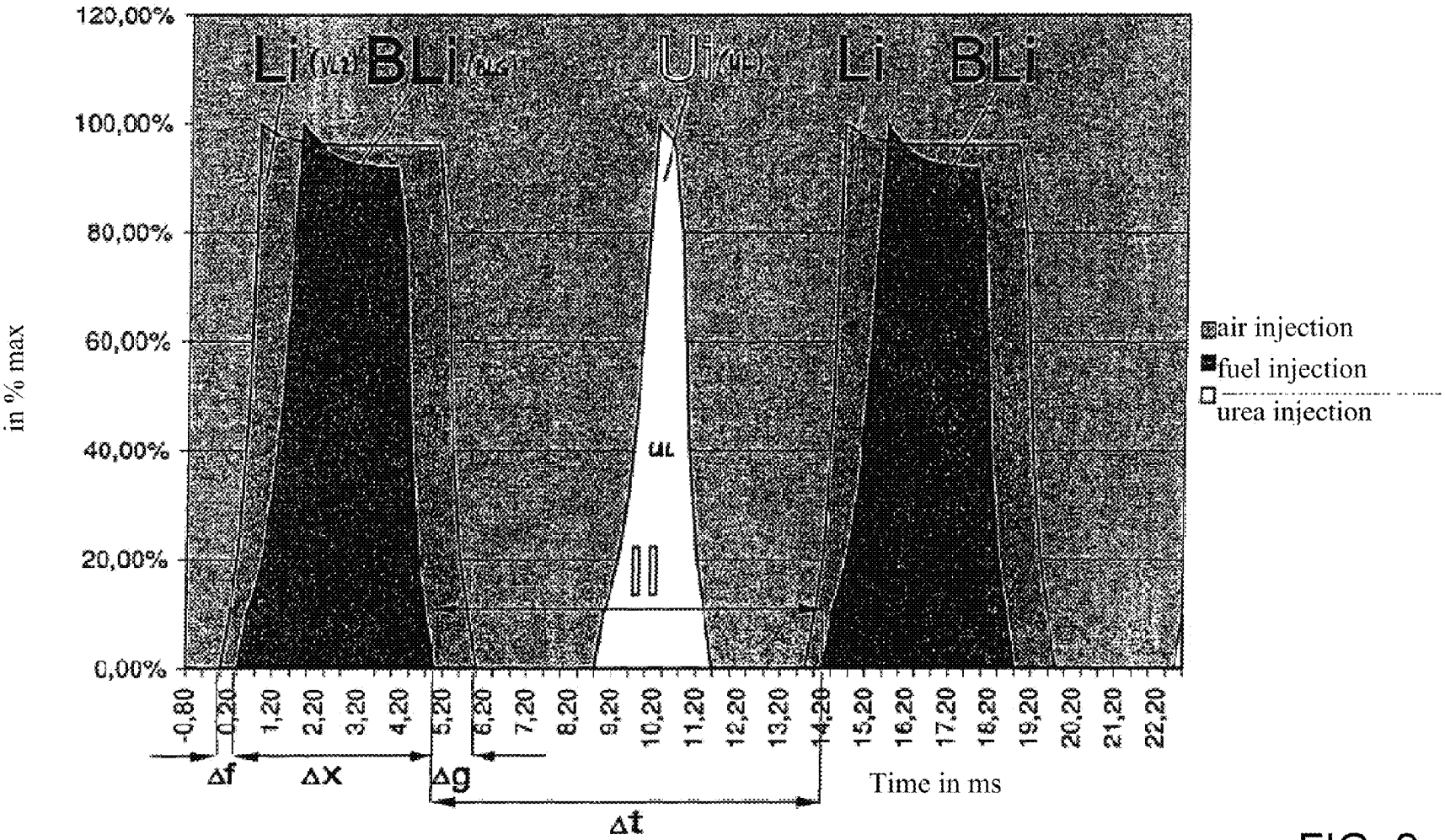

FIG. 2 shows a specific diagram of the time plot of the injections of fuel/air mixture, second volume portion VL2 of combustion air VL, and urea solution UL into the combustion chamber 10.

Plotted along the y-axis are the maximum amounts of fuel/air mixture injection pulses BLI, and admission pulses of the second volume portion VL2, supplied to the nozzle 30, of the total required combustion air VL, beginning shortly before the start of the former and likewise ending shortly after their end, and of the urea admission pulse UI, introduced in the interval II between these two admission pulses and lasting for around $\Delta t$=9.2 ms here, for the urea solution UL admitted into the combustion chamber 10 at its cool side via the nozzle 40 located there.

On the x-axis is plotted the time in ms, and one can read off there the short periods $\Delta t$ between the beginning of the air (VL2) pulse LI and the beginning of the fuel injection pulse BLI and $\Delta g$ between the end of same and the end of the air pulse LI, as well as the time between beginning and end of each of the fuel/air mixture pulses BLI.

The invention claimed is:

1. A method for burning liquid fuels in a plant, using at least one injection nozzle protruding into a combustion chamber substantially at ambient pressure and in direct communication with external atmosphere through an exhaust conduit, the at least one injection nozzle adapted for being charged intermittently with a liquid fuel under pressure, and a supply of combustion air arranged in immediate proximity to a nozzle port of the at least one injection nozzle, comprising the steps of:

introducing a first volume portion of air in the form of small diameter air bubbles into a liquid fuel in an amount required for an actual complete combustion of the liquid fuel, to form a liquid fuel/air mixture;

formulating the liquid fuel/air mixture in at least one stage at a constant pressure of at least about 10 bar, and in the case of high-viscosity liquid fuels of at least about 100 bar, and supplying a volume of liquid fuel/air mixture intermittently as pulses to the injection nozzle;

finely atomizing the liquid fuel/air mixture in an explosive manner using a constantly maintained injection pressure in the combustion chamber;

maintaining the time duration and the quantity of the liquid fuel/air mixture admitted with each fuel injection pulse at a substantially constant heating value;

adjusting the total quantity of liquid fuel/air mixture injected into the combustion chamber per unit of time, to determine heating power of the plant, by varying time duration between fuel/air injection pulses; and admitting intermittingly into the combustion chamber a remaining second and larger volume portion of combustion air, through an air nozzle annularly surrounding the nozzle port.

2. The method according to claim 1, including the step of: intermittingly supplying the remaining, second and larger volume portion of combustion air in the vicinity of the nozzle port such that each of the air admission pulses starts a short time before the beginning of the individual fuel/air injection pulses and ends a short time after the end of each individual fuel/air injection pulse.

3. The method according to claim 1, including the step of: intermittently spraying a urea solution through at least one urea injection nozzle into a region of the combustion chamber having at least one exhaust flue to control limits of nitrogen oxide emissions, and regulating the volume of urea solution admitted per urea injection pulse relative to the volume of liquid fuel/air mixture admitted by the fuel/air injection nozzle per fuel/air injection pulse, starting the respective urea pulse within a short interval of time after the end of each of the injection pulses of the liquid fuel/air mixture and ending the urea pulses within a short interval of time before starting the next fuel/air injection pulse, when no flame is burning in the combustion chamber.

4. The method according to claim 3, including the steps of: maintaining the duration of the urea injection pulses at about 0.5 to about 10 ms, more particularly about 1 to about 5 ms, and injecting the urea injection pulses each time substantially in the middle of the time interval or between the end of a preceding fuel/air injection pulse and the beginning of the following fuel/air injection pulse.

5. The method according to claim 1, including the step of: determining current actual volume of the first volume portion of combustion air and the respective actual volume of liquid fuel is by continual collection of data and measurement of at least one capacitive, densitometric or radiation absorption properties of the liquid fuel/air mixture flow upstream from its entry into a high-pressure pump applying pressure to the liquid fuel/air mixture, and delivering the data for the first, smaller volume portion introduced into the liquid fuel is to a feedback controller for regulating combustion air provided by an air proportioning device.

6. The method according to claim 5, including the steps of: reducing excess liquid fuel/air mixture of the high-pressure pump and/or the fuel/air injection nozzle, before being admitted again into the high-pressure pump, by using air contained in the liquid fuel/air mixture in a settling tank having an air separator.

7. The method according to claim 1, including the step of: preheating the liquid fuel to a lower viscosity value to enable the fuel/air injection nozzle to provided flow and atomizing capability, before admitting the first, smaller combustion air portion to the liquid fuel/air mixture.

8. The method according to claim 1, including the step of: controlling the length or duration of each fuel/air injection pulse to provide a plant heating power range at a predetermined constant value.

9. The method according to claim 1, including the step of: controlling and maintaining constant the time spans or intervals or between the individual fuel/air injection pulses to provide a desired plant heating power range.

10. The method according to claim 1, including the step of: controlling the time spans for the admission pulses of the remaining or second and larger intermittently admitted volume portion of the combustion air to the fuel/air injection nozzle at between about 0.1 and about 1.0 ms before the beginning the pulses and about 0.1 to about 0.5 ms after ending each fuel/air injection pulse.

11. The method according to claim 1, including the step of: preheating the remaining or second and larger volume portion of combustion air supplied in the region of the liquid fuel/air injection nozzle through a heat exchanger in the combustion chamber of the plant.

12. The method according to claim 1, including the step of: regulating the remaining or second and larger volume portion of the combustion air using a lambda probe connected to a air feed regulator arranged in a combustion exhaust flue.

13. The method according to claim 12, including the step of: controlling through at least one valve controlled by the regulator the intermittent supply of liquid fuel/air mixture to the fuel/air injection nozzle and/or the remaining or second and larger volume portion of the combustion air to the air admission nozzle.

14. The method according to claim 1, including the step of: regulating the quantity of combustion air admitted into the combustion chamber by the air admission nozzle for each air admission pulse.

15. The method according to claim 1, wherein: at least one of high-voltage arc igniter or spark plug is used to ignite the liquid fuel/air mixture.

16. The method according to claim 1, including the step of: blowing air into a fuel cloud in the combustion chamber is done through an air intake arranged in the vicinity of the fuel injection nozzle and supplied with air by a blower.

* * * * *